US005842834A

United States Patent [19]

Kawaguchi et al.

[11] Patent Number: 5,842,834

[45] Date of Patent: Dec. 1, 1998

[54] SWASH PLATE TYPE COMPRESSOR EMPLOYING SINGLE-HEADED PISTONS

[75] Inventors: Masahiro Kawaguchi; Ken Suitou; Masanori Sonobe; Tomohiko Yokono, all of Kariya, Japan

[73] Assignee: Kabushiki Kaisha Toyoda Jidoshokki Seisakusho, Kariya, Japan

[21] Appl. No.: 698,921

[22] Filed: Aug. 16, 1996

[30] Foreign Application Priority Data

Aug. 21, 1995 [JP] Japan ..... 7-212208

[51] Int. Cl.[6] ..... F04B 1/29

[52] U.S. Cl. ..... 417/222.2

[58] Field of Search ..... 417/222.2, 295, 417/269, 222.1

[56] References Cited

U.S. PATENT DOCUMENTS

| | | | |
|---|---|---|---|
| 5,173,032 | 12/1992 | Taguchi et al. | 417/222.2 |
| 5,584,670 | 12/1996 | Kawaguchi et al. | 417/222.2 |
| 5,603,610 | 2/1997 | Kawaguchi et al. | 417/222.2 |
| 5,624,240 | 4/1997 | Kawaguchi et al. | 417/222.2 |
| 5,681,150 | 10/1997 | Kawaguchi et al. | 417/222.2 |

FOREIGN PATENT DOCUMENTS

| | | |
|---|---|---|
| 4446832 | 6/1995 | Germany . |
| 62-674 | 1/1987 | Japan . |
| 62-276279 | 12/1987 | Japan . |
| 6346845 | 12/1994 | Japan . |

*Primary Examiner*—Ismael Izaguirre
*Attorney, Agent, or Firm*—Brooks Haidt Haffner & Delahunty

[57] ABSTRACT

A swash plate is arranged to tilt between a maximum inclining angle and a minimum inclining angle based on differential pressure between a crank chamber and a suction chamber. At least one single-headed piston, that is coupled to the swash plate, is disposed in an associated cylinder bore and reciprocates at a stroke according to the inclining angle of the swash plate to compress refrigerant gas introduced to the cylinder bore from an external refrigerant circuit via the suction chamber. A pressure supply passage connects a discharge chamber with the crank chamber to supply the refrigerant gas from the discharge chamber into the crank chamber so as to increase the pressure in the crank chamber and a flow passage which allows flow of the refrigerant gas from the crank chamber to the suction chamber. An introducing passage introduces the refrigerant gas with low temperature from the external refrigerant circuit to substantially equalize the pressures in the crank chamber and the suction chamber. Movable elements selectively open and close the introducing passage in association with the maximum inclining angle and minimum inclining angle of the swash plate.

24 Claims, 4 Drawing Sheets

SWASH PLATE TYPE COMPRESSOR EMPLOYING SINGLE-HEADED PISTONS

BACKGROUND OF THE INVENTION

1. Field of The Invention

The present invention relates to swash plate type compressors, and more particularly, to swash plate type compressors that employ single-headed pistons.

2. Description of the Related Art

Compressors are incorporated in cooling circuits for vehicle air-conditioning apparatuses. A typical compressor alters its compressor displacement in accordance with the temperature in the passenger's compartment. There is a type of compressor that employs swash plates. The swash plate inclines to adjust the stroke of the pistons and thus control the compressor displacement.

U.S. patent application Ser. No. 08/225,043 (Kawaguchi et al.), now U.S. Pat. No. 5,558,718 describes a swash plate type compressor. As shown in FIG. 5, the compressor has a housing 100. Cylinder bores 101 are defined in the housing 100. Each bore 101 accommodates a reciprocal piston 102. A rotary shaft 104 extends through a crank chamber 103, which is defined in the housing 100. A lug plate 105 is fixed to the shaft 104. A swash plate 106 is mounted on the shaft 104 and supported by the lug plate 105 in a manner enabling the swash plate 106 to incline with respect to the shaft 104. The rotation of the swash plate 104 causes the reciprocation of the pistons 102. A pressurizing passage 108 connects a discharge chamber 107 to the crank chamber 103. The passage 108 is provided with an electromagnetic valve 109 that is operated by a switch for the air-conditioning apparatus.

When cooling is not required, the valve 109 is selectively opened to incline the swash plate 106 to a minimum inclining position by utilizing the obtained difference between the pressure in the crank chamber 103 and the pressure in the cylinder bores 101 (or compression chambers 113 defined therein). At this position, the swash plate 106 is inclined at an angle slightly greater than zero degrees with respect to a direction perpendicular to the axis of the shaft 104. In addition, the displacement of the compressor is minimum when the swash plate 106 is at this position. In this state, a suction passage 111 is closed by a shutter 112. This causes the small amount of refrigerant gas remaining in the compressor to circulate therein and lubricate sliding parts such as the swash plate 106. When cooling becomes required, the switch selectively closes the valve 109 to reduce the pressure difference and increase the inclination of the swash plate 106. When the swash plate 106 inclines to a maximum inclining position, the compressor displacement becomes maximum.

The compressor described above does not require a clutch to connect the compressor to an external drive source (e.g., vehicle engine). This reduces both production costs and the overall weight of the air-conditioning apparatus. The elimination of the clutch also suppresses shocks that are produced when sudden torque fluctuations take place due to the energizing and de-energizing of the electromagnetic valve.

Refrigerant is first drawn into the compressor from an external refrigerant circuit and then compressed by the pistons 102. The compression causes the temperature of the refrigerant gas to become extremely high. The high-temperature refrigerant gas is discharged from the discharge chamber 107 and then cooled by an evaporator or the like provided in the external refrigerant circuit.

When the compressor is operated in a state that the compressor displacement is at a high level, compression of the refrigerant gas increases the temperature and the pressure of the gas in each compression chamber 113. As a result, the gas leaks into the crank chamber 103. This so-called blowby gas increases the temperature in the crank chamber 103. In addition, the opening of the valve 109 causes the high-temperature, high-pressure gas in the discharge chamber 107 to be drawn into the crank chamber 103. This increases the difference between the pressure in the crank chamber 103 and the pressure in the suction chamber 110 and thus reduces the compressor displacement. The constant high-temperature, high-pressure state in the crank chamber 103 is not preferable in consideration of the durability of the sliding parts arranged therein such as the swash plate 106 and lip seal 114.

To enhance the durability of the lip seal 114, it is necessary to employ a seal made of an expensive material. To enhance the durability of the swash plate 106, it is necessary to thermal spray a material having a superior lubricating property, such as copper or lead, on the surface of the swash plate which is made of an iron material. This increases production costs.

SUMMARY OF THE INVENTION

Accordingly, it is a primary objective of the present invention to provide a piston type compressor that upgrades the durability of a lip seal and a swash plate.

To achieve the above object, an improvement of a swash plate type compressor is provided. The compressor has a swash plate that is tiltably mounted on a drive shaft in a crank chamber. The swash plate is arranged to tilt between a maximum inclining angle and a minimum inclining angle based on differential pressure between a crank chamber and a suction chamber. At least one single-headed piston is disposed in an associated cylinder bore. The piston is coupled to the swash plate and reciprocates at a stroke according to the inclining angle of the swash plate to compress refrigerant gas introduced to the cylinder bore from an external refrigerant circuit via the suction chamber. A pressure supply passage connects a discharge chamber with the crank chamber to supply the refrigerant gas from the discharge chamber into the crank chamber so as to increase the pressure in the crank chamber. A flow passage allows flow of the refrigerant gas from the crank chamber to the suction chamber. An introducing passage introduces the refrigerant gas with low temperature from the external refrigerant circuit to substantially equalize the pressures in the crank chamber and the suction chamber. Movable elements selectively open and close the introducing passage in association with the maximum inclining angle and minimum inclining angle of the swash plate.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

An embodiment according to the present invention will hereafter be described with reference to FIGS. 1 to 4. The left side of the drawings corresponds to the front side of the compressor while the right side of the drawings correspond to the rear side.

Figure 1:
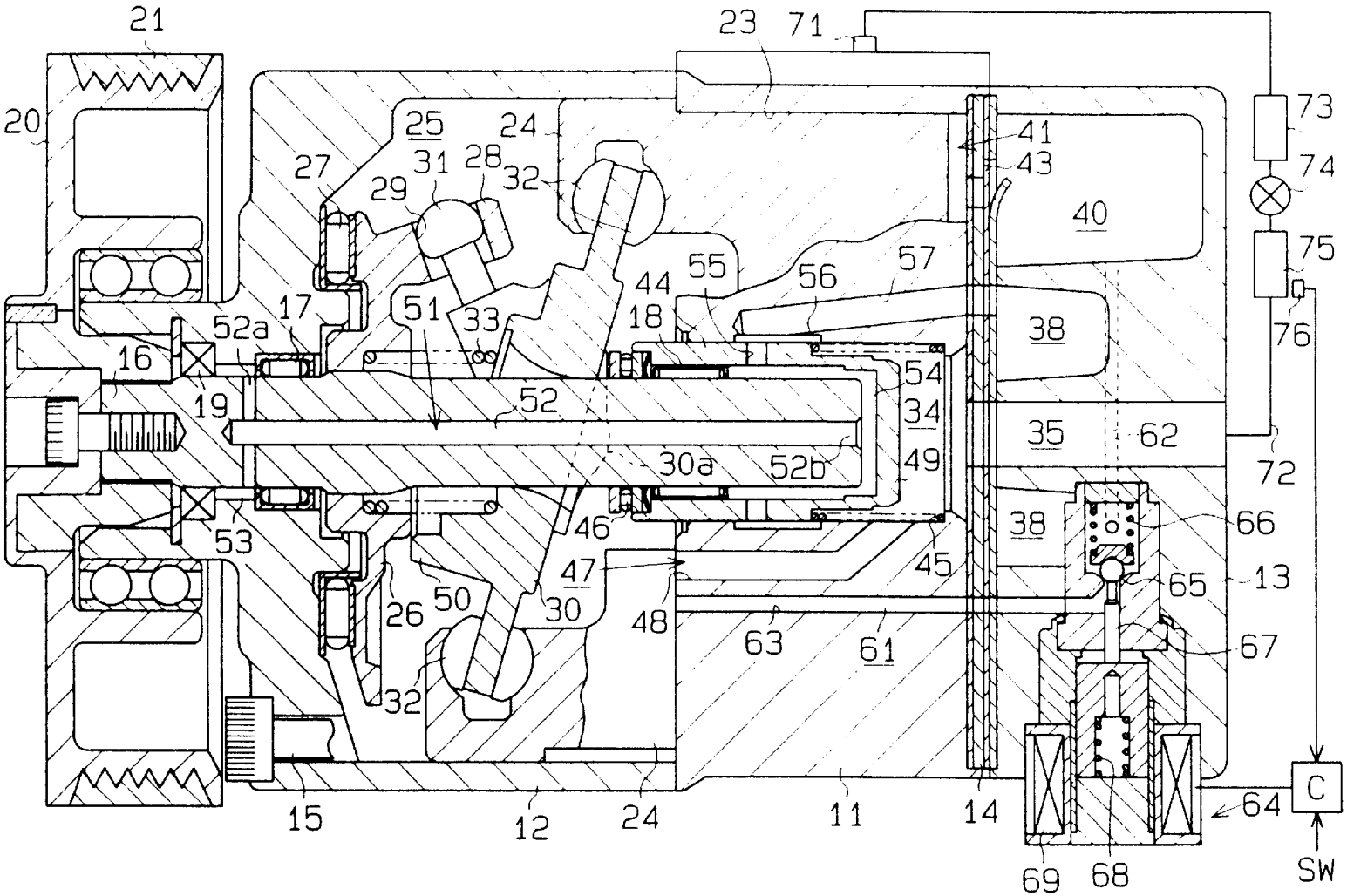
FIG. 1 is a cross-sectional view showing a compressor according to an embodiment of the present invention in which the compressor is operated in a state that its displacement is maximum.

As shown in FIG. 1, a front housing 12 is coupled to the front end of a cylinder block 11. A rear housing 13 is coupled to the rear end of the cylinder block 11 with a valve plate 14 located therebetween. The cylinder block 11 defines part of a compressor housing. That is, the compressor housing is defined by the front housing 12, the cylinder block 11, and the rear housing 13. The front housing 12 and the rear housing 13 are fastened to the associated ends of the cylinder block 11 by a plurality of bolts 15.

A rotary shaft 16 is rotatably supported in the center of the cylinder block 11 and the front housing 12 by front and rear radial bearings 17, 18. A lip seal 19 is provided between the front end of the shaft 16 and the front housing 12. A pulley 20 is mounted on the front end of the shaft 16 outside the front housing 12 and connected directly to a vehicle engine (not shown) by a belt 21.

A plurality of cylinder bores 23 extend through the cylinder block 11. A single-headed piston 24 is accommodated in each bore 23. A crank chamber 25 is defined in the front housing 12 in front of the cylinder block 11. A lug plate 26 is secured to the shaft 16 in the crank chamber 25 and rotates integrally with the shaft 16. A thrust bearing 27 enables the lug plate 26 to rotate along the inner wall of the front housing 12. A support arm 28 projects from the lug plate 26. A pair of guide apertures 29 are formed in the distal end of the lug plate 26.

A substantially disk-shaped swash plate 30, which is made of an aluminum material, is fitted on the shaft 16. The swash plate 30 is inclinable with respect to the shaft 16. A pair of connectors 31, which corresponds to the pair of guide apertures 29 in the lug plate 26, project from the front side of the swash plate 30. The spheric end of each connector 31 is fitted into the associated guide aperture 29 in a manner such that the connector 31 is slidable therein during rotation of the shaft 16. This hinge connects the swash plate 30 with the lug plate 26 and enables the swash plate 30 to incline in both forward and rearward directions with respect to the shaft 16. Each piston 24 is coupled to the swash plate 30 by a pair of semispheric shoes 32. Rotation of the shaft 16 causes the lug plate 26 to rotate with the swash plate 30. This, in turn, reciprocates each piston 24 within each associated bore 23. A spring 33 is arranged between the lug plate 26 and the swash plate 30 to incline the swash plate 30 toward a minimum inclining position.

A shutter chamber 34 extends through the center of the cylinder block 11. The axis of the shutter chamber 34 coincides with the axis of the shaft 16. A shutter 44 is retained in the shutter chamber 34. A suction port 35 is provided extending through the center section of the rear housing 13 and the valve plate 14. The suction port 35 is connected with the shutter chamber 34. The shutter chamber 34 is connected to the crank chamber 25 by a communicating passage 48. Accordingly, a first path 47, which connects the suction port 35 to the crank chamber 25, is defined by the shutter chamber 34 and the communicating passage 48.

A suction chamber 38 is defined in the center section of the rear housing 13 in a manner such that it encompasses the suction port 35. A discharge chamber 40 is defined in the peripheral section of the rear-housing 13.

Figure 2:
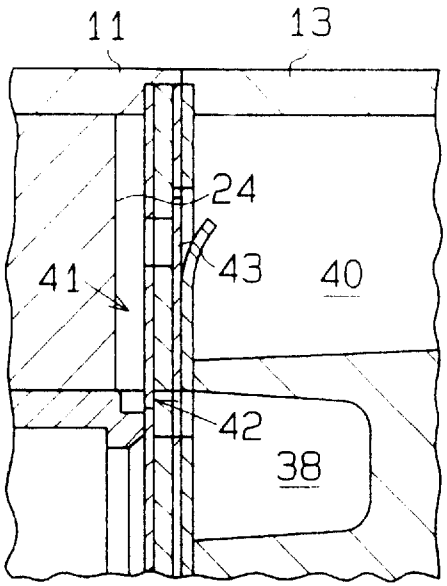
FIG. 2 is an partially enlarged cross-sectional view showing a suction valve mechanism and a discharge valve mechanism.

As shown in FIG. 2, a suction valve mechanism 42 is provided in the valve plate 14. Reciprocation of each piston 24 causes the refrigerant gas in the suction chamber 38 to be drawn into a compression chamber 41 defined in the associated bore 23. A discharge valve mechanism 43 is also provided in the valve plate 14. Reciprocation of each piston 24 causes the high-temperature refrigerant gas compressed in the compression chamber 41 of each associated bore 23 to be discharged into the discharge chamber 40 through the discharge mechanism 43.

The shutter 44 is adapted in the shutter chamber 34 to be movable in the axial direction of the chamber 34. The shutter 44 opens and closes the first path 47. A spring 45 urges the shutter 44 forward. This causes the shutter 44 to abut against a protuberance 30*a* defined in the center section of the rear side of the swash plate 30. The shutter 44 slides along the peripheral surface of the rear end of the shaft 16 by way of the radial bearing 18. Radial load produced by the rotation of the shaft 16 is carried by the radial bearing 18. A thrust bearing 46, which is slidable along the shaft 16, is arranged between the shutter 44 and the swash plate 30. The thrust load produced by the inclining and rotation of the swash plate 30 is carried by the thrust bearing 46.

Figure 4:
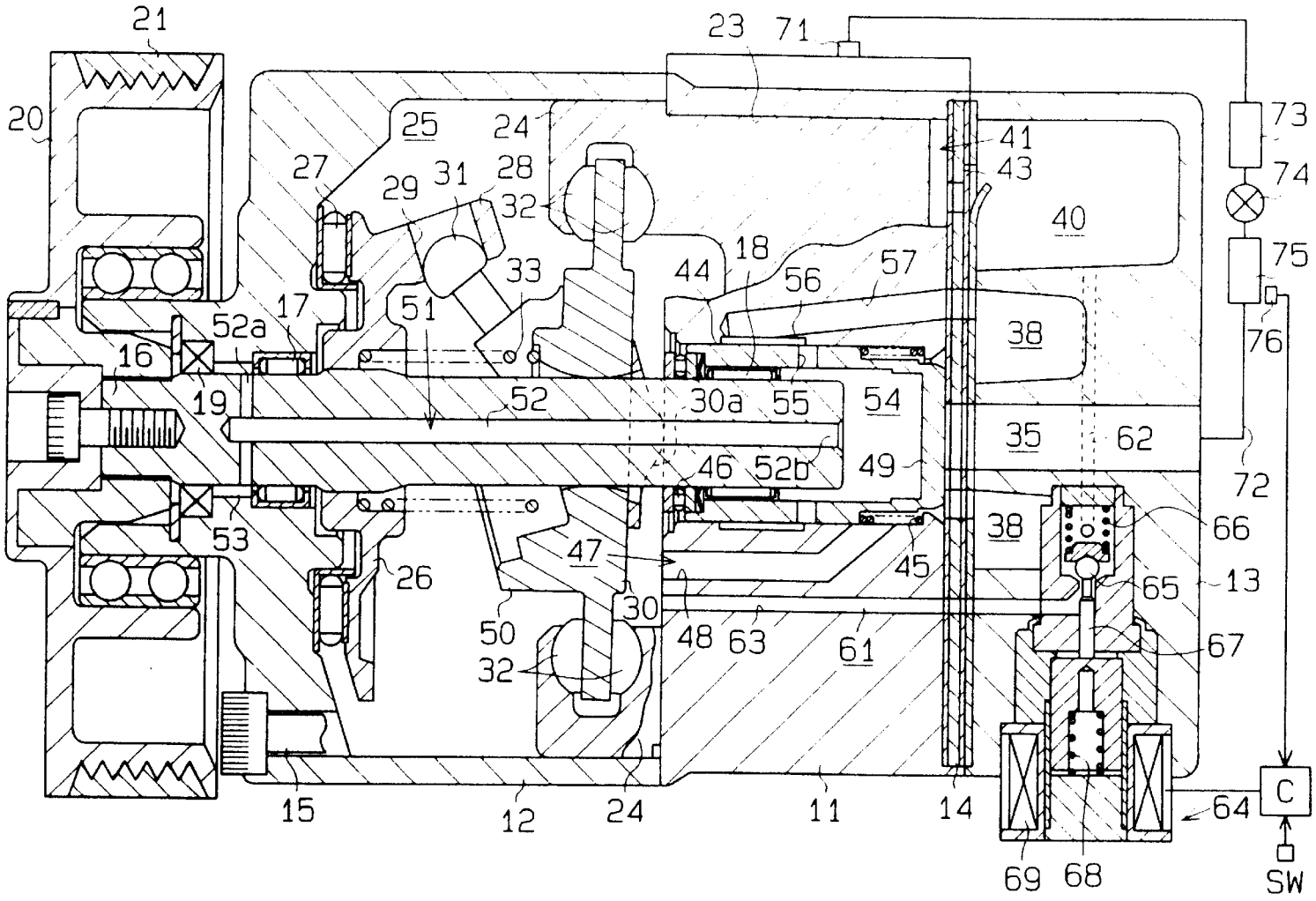
FIG. 4 is a cross-sectional view of the compressor showing the compressor operated in a state that its displacement is minimum.
Figure 5:
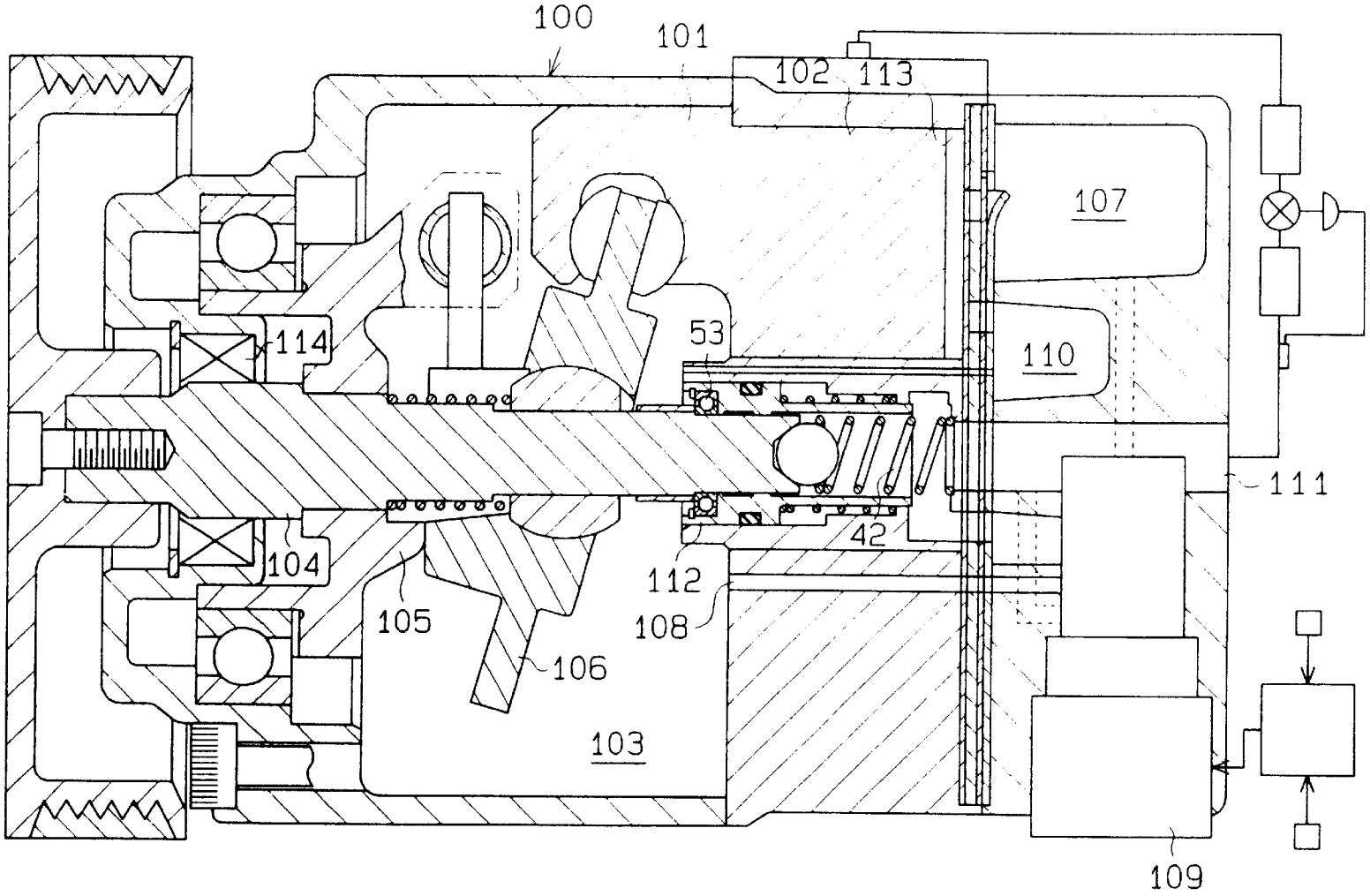
Fig. 5 (Prior Art)
FIG. 5 is a cross-sectional view showing a prior art compressor.

A shutting surface 49, which corresponds to the suction port 35, is defined at the rear end face of the shutter 44. As shown in FIG. 4, the protuberance 30*a* moves to a rearward position as the swash plate 30 inclines toward the minimum inclining position. This moves the shutter 44 rearward against the urging force of the spring 45 and causes the shutting surface 49 to close the front opening of the suction port 35. As a result, the suction port 35 is disconnected from the first path 47. This impedes the flow of refrigerant gas from the suction port 35 to the crank chamber 25. The angle of the swash plate 30 with respect to a direction perpendicular to the axis of the shaft 16 is slightly greater than zero degrees when the swash plate 30 is at the minimum inclining position. The minimum inclining position, which corresponds to a closing position of the shutter 44, is restricted by the engagement between the shutter 44 and the valve plate 14.

As shown in FIG. 1, when the swash plate 30 is inclined in a frontward direction to a maximum inclining position, the shutter 44 is moved forward by the spring 45. As the shutter 44 moves forward, the shutting surface 49 moves away from the opening of the suction port 35. When at the maximum inclining position, the shutter 44 enables the refrigerant gas in the suction port 35 to be drawn into the crank chamber 25. The rotation of the swash plate 30, located at the maximum inclining position, results in the compressor being operated with the compressor displacement at a maximum level. The maximum inclining position of the swash plate 30 is restricted by the abutment between a restricting projection 50, which projects from the swash plate 30, and the lug plate 26.

A pressurizing path 61 is defined by a passageway 62, which extends through the rear housing 13, and a passageway 63, which extends through the cylinder block 11 from the rear housing 13. The pressurizing path 61 serves as a second passage and connects the discharge chamber 40 to the crank chamber 25.

Figure 3:
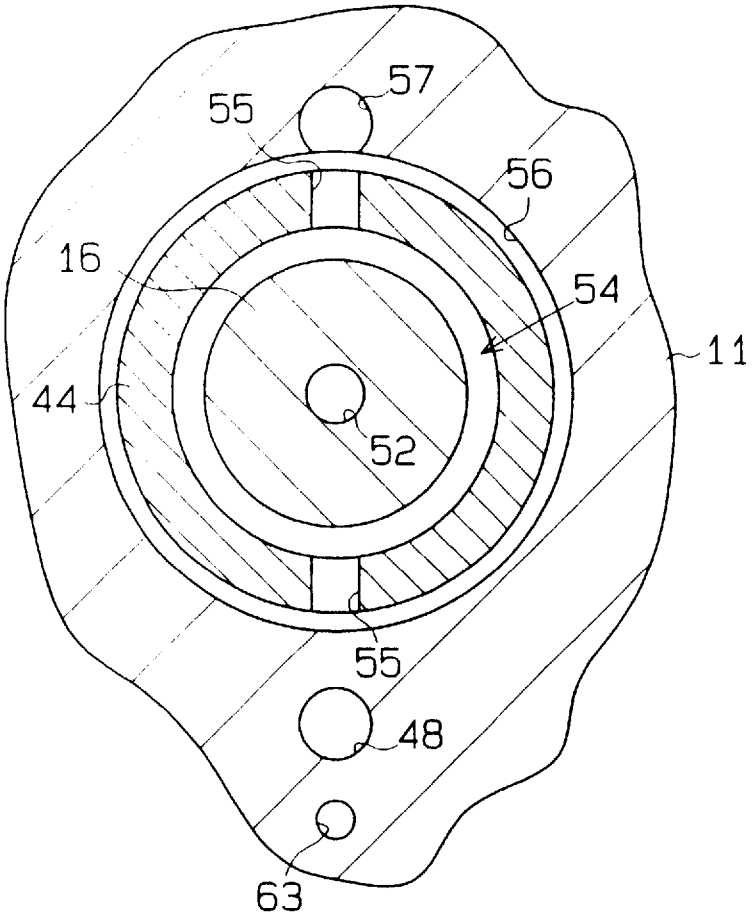
FIG. 3 is an enlarged cross-sectional view showing the compressor at the vicinity of the spool.

The crank chamber 25 is connected to the suction chamber 38 by a third path 51. A longitudinal passage 52 is defined along the axis of the shaft 16. The passage 52 extends substantially through the entire shaft 16. The upstream side (front end) of the passage 52 is connected to a seal chamber 53 by a transverse passage 52*a* which extends in the radial direction of the shaft 16. The seal chamber 53 is connected to the crank chamber 25 through the space defined in the radial and thrust bearings 17, 27. An opening 52*b* at the downstream side (rear end) of the passage 52 is connected to a communicating chamber 54 defined in the shutter 44. A notch 56 is defined in the wall of the shutter chamber 34. As shown in FIG. 3, the notch 56 is connected to the communicating chamber 54 by holes 55 extending through the wall of the shutter 44. The holes 55 serve to restrict and adjust the flow rate of the refrigerant gas passing therethrough from the communicating chamber 54 to the notch 56 as the shutter 44 moves between the positions shown in FIG. 1 and FIG. 4. A guide passage 57, which is defined in the cylinder block 11, connects the notch 56 to the suction chamber 38.

As shown in FIG. 1, when the compressor displacement is maximum, the refrigerant gas in the crank chamber 25 is drawn into the suction chamber 38 by way of the third path 51. The third path 51 is defined by the space between the bearings 27, 17, the seal chamber 53, the transverse passage 52*a*, the longitudinal passage 52, the opening 52*b*, the communicating chamber 54, the holes 55, the notch 56, and the guide passage 57.

The passageway 62 is provided with a switch SW for the air-conditioning apparatus and an electromagnetic valve 64. The valve 64 is selectively energized and de-energized in response to signals from a temperature sensor 76. The valve 64 includes a valve body 65, springs 66, 68, a rod 67, and a solenoid 69. The spring 66 constantly urges the valve body 65 toward a direction closing the valve 64. The rod 67 moves the valve body 65 and closes the valve 64 when the valve 64 is energized. The spring 68 causes the valve body 65 to open the valve 64 when the valve 64 is de-energized. The solenoid 69 moves the valve body 65 with the rod 67 when excited. The solenoid 69 is connected to the switch SW and the temperature sensor 76 by way of a control circuit C. The control circuit C selectively energizes and de-energizes the solenoid 69 in response to signals from the switch SW and the temperature sensor 76. The valve 64 opens the pressurizing path 61 when de-energized and closes the path 61 when energized. In the state shown in FIG. 1, the valve 64 is energized and the pressurizing path 61 is thus closed.

An external refrigerant circuit 72 connects a discharge port 71, which the refrigerant gas in the discharge chamber 40 is discharged through, to the suction port 35, which the refrigerant gas sent to the suction chamber 38 is drawn through. The refrigerant circuit 72 includes a condenser 73, an expansion valve 74, and an evaporator 75. The expansion valve 74 controls the flow rate of the refrigerant gas in accordance with the fluctuation of the gas pressure at the outlet side of the evaporator 75. The temperature sensor 76 detects the temperature at the outlet side of the evaporator 75. The sensor 76 de-energizes the valve 64 to decrease the compressor displacement when the temperature sensor 76 detects the temperature at the outlet side of the evaporator 75 becoming lower than a predetermined lower limit value. The decrease in temperature indicates that the requirement for cooling is small. Contrarily, the sensor 76 energizes the valve 64 to increase the compressor displacement when the temperature sensor 76 detects the temperature at the outlet side of the evaporator 75 becoming higher than a predetermined upper limit value. The increase in temperature indicates that the requirement for cooling is high.

The operation of the preferred and illustrated embodiment according to the present invention will now be described.

In the state shown in FIG. 1, the compressor displacement is maximum. In this state, the switch SW for the air-conditioning apparatus is turned on and the valve 64 is energized. Thus, the pressurizing path 61 is closed. This impedes the flow of high-pressure gas from the discharge chamber 40 to the crank chamber 25. Since the shutter 44 is moved away from the first path 47, the refrigerant gas from the external refrigerant circuit 72 is drawn into the crank chamber 25 via the suction port 35 and the first path 47. Thus, the temperature in the crank chamber 25 is not increased.

The holes 55 are entirely opened to the notch 56. That is, the third path 51 connects the crank chamber 25 to the suction chamber 38 in a state free of flow restriction. Therefore, the refrigerant gas in the crank chamber 25 flows smoothly into the suction chamber 38 by way of the third path 51. This maintains the pressure in the crank chamber 25 at a value substantially equal to the low suction pressure in the suction chamber 38. In this state, the swash plate 30 is maintained at the maximum inclining position by a pressure difference $\Delta P$ obtained between the pressure Pc in the crank chamber 25 and the pressure Ps in the cylinder bores 23, and by the urging force of the springs 33, 45. This maintains the compressor displacement at a maximum level.

Continuation of the compressor being operated in a maximum displacement state sufficiently cools the passenger's compartment and thus decreases the requirement for cooling. When the temperature of the evaporator 75 becomes lower than a predetermined temperature, which corresponds to the temperature that starts formation of frost, the temperature sensor 76 sends a signal to de-energize the valve 64. This opens the pressurizing path 61, or the second path, and connects the discharge chamber 40 to the crank chamber 25. Thus, the high-temperature, high-pressure gas in the discharge chamber 40 is sent to the crank chamber 25 by way of the pressurizing path 61. This increases the pressure in the crank chamber 25 and causes an increase in the pressure difference $\Delta P$. Thus, the swash plate 30 inclines toward the minimum inclining position shown in FIG. 4. As the swash plate 30 inclines toward the minimum inclining position, the protuberance 30*a* causes the shutter 44 to slide toward the suction port 35 as it compresses the spring 45. Abutment of the shutting surface 49 against the wall surrounding the opening of the suction port 35 restricts the swash plate 30 at the minimum inclining position. The abutment also disconnects the shutter chamber 34 from the suction port 35 and closes the first path 47. Accordingly, the flow of refrigerant gas from the external refrigerant circuit 72 to the crank chamber 25 is impeded.

As described above, low-temperature refrigerant gas is supplied to the crank chamber 25 from the external refrigerant circuit 72 by way of the first path 47 when the compressor displacement is at a high level. Accordingly, the low-temperature refrigerant gas is trapped in the crank chamber 25 when the compressor displacement becomes minimum. This prevents deterioration of the lip seal 19 and the swash plate 30 and allows the swash plate 30 to be made from a light-weight metal such as aluminum. As a result, the weight of the compressor may be reduced. Furthermore, production of the compressor is facilitated and production costs are thus decreased.

Since the angle of the swash plate 30 at the minimum inclining position is not zero degrees, the pistons 24 reciprocate within a certain stroke when the compressor displacement is minimum. In other words, the stroke of the pistons 24 is not zero when the compressor displacement is minimum. Thus, the refrigerant gas in the compression chamber 41 defined in each bore 23 is discharged into the discharge chamber 40. The difference between the pressure in the discharge chamber 40 and the crank chamber 25 causes the refrigerant gas discharged into the discharge chamber 40 to circulate in the compressor. The circulation takes place between the pressurizing path 61, the crank chamber 25, the third path 51, the suction chamber 38, the compression chambers 41, and the discharge chamber 40. The circulation of the refrigerant gas in the compressor lubricates the sliding parts inside the compressor with the lubricating oil mixed in the refrigerant gas.

As shown in FIG. 4, when the compressor is operated in the state that the compressor displacement is minimum, the shutter 44 narrows the opening between the holes 55 and the notch 56. This restricts the third path 51. As a result, the pressure Pc in the crank chamber 25 is maintained at a value higher than the value of the pressure Ps in the cylinder bores 23. The pressure difference ΔP, obtained between the pressure Pc in the crank chamber 25 and the pressure Ps in the cylinder bores 23, stably maintains the swash plate 30 at the minimum inclining position. This enables the compressor to continue stable operation in the state which the compressor displacement is minimum.

When the compressor displacement becomes minimum, high-pressure gas discharged into the discharge chamber 40 is supplied through the pressurizing path 61 into the crank chamber 25, which pressure therein had been substantially the same as the suction pressure and thus low. The pressure of the discharged gas inclines the swash plate 30 to the minimum inclining position. In the prior art, the pressure Pc in the crank chamber 25 was high and the pressure difference ΔP with the pressure Ps was thus great. Accordingly, it was required that the spring 45 have a large urging force to alter the inclination of the swash plate 30. In comparison, the structure according to the present invention enables the spring 45 to have a small urging force. This, in turn, enables the swash plate 30 to be inclined toward the minimum inclining position with a small pressure difference ΔP. Accordingly, the amount of gas required to be supplied to the crank chamber 25 is small. Therefore, the amount of refrigerant gas trapped in the crank chamber 25 is relatively small compared to prior art compressors. This suppresses liquefying of the refrigerant and suppresses the amount of lubricating oil that would be lost by the liquefying. Hence, the lubricating capability of the compressor is enhanced.

When the compressor is operated in a minimum displacement state and the requirement for cooling becomes high, a signal from the temperature sensor 76 energizes the valve 64 and closes the pressurizing path 61. The pressure in the crank chamber 25 decreases since the pressure in the crank chamber 25 is released into the suction chamber 38 through the third path 51. The pressure decrease inclines the swash plate 30 toward the maximum inclining position from the minimum inclining position. The inclining of the swash plate 30 urges the shutter 44 frontward with the spring 45. This opens the first path 47 and enables the refrigerant gas from the external refrigerant circuit 72 to be drawn into the crank chamber 25 through the first path 47. Furthermore, the discharged gas, the volume of which is large, is discharged into the external refrigerant circuit 72 from the discharge chamber 40. The closing of the pressurizing path 61 also terminates circulation of the refrigerant gas in the compressor. Since the holes 55 in the shutter 44 become opened entirely, the third path 51 becomes free of a flow restriction. Thus, the refrigerant gas in the crank chamber 25 flows into the suction chamber 38 through the third path 51 without any pressure loss when the compressor is operated with its displacement maintained at a high level.

As the compressor continues operation with its displacement maintained at a high level, the requirement for cooling becomes low. This causes the temperature sensor 76 to energize the valve 64 and open the pressurizing path 61. This increases the pressure difference ΔP, which is obtained between the pressure Pc in the crank chamber 25 and the pressure Ps in the cylinder bores 23. As a result, the swash plate 30 inclines toward the minimum inclining position from the maximum inclining position. Since the compressor had been operated with it displacement at a high level, the temperature and pressure in the crank chamber 25 is low. Thus, the lip seal 19 and the swash plate 30 are not exposed to refrigerant gas which temperature and pressure is high. This enhances the durability of the lip seal 19 and the swash plate 30.

The operation of the compressor when the switch SW for the air-conditioning apparatus is turned on has been described above. When the switch SW is turned off, the valve 64 is de-energized regardless of the requirement for cooling. In this state, the compressor displacement is minimum.

When the engine is stopped, the operation of the compressor is terminated and the valve 64 is de-energized. Thus, the swash plate 30 is inclined at the minimum inclining position when the compressor is not operating. This suppresses shocks that are produced when the engine is started again.

In the above embodiment, the shutter 44, which serves as a shutting means, moves together with the inclination of the swash plate 30. This simplifies the structure of the compressor. Furthermore, the third path 51 has an upstream opening connected with the seal chamber 53. This exposes the seal chamber 53 to the drawn in refrigerant gas and improves the lubrication of the bearings 17, 27 and the lip seal 19.

The present invention may be modified as described below.

(1) An electromagnetic clutch may be arranged between the shaft 16 and the pulley 20 to selectively connect and disconnect the compressor to an external drive source. In this case, the clutch is energized when the switch SW for the air-conditioning apparatus is turned on. The compressor displacement varies between the maximum level and the minimum level by selectively opening and closing the valve 64 in accordance to a signal from the sensor 76. By turning off the switch SW, the clutch is de-energized and the operation of the compressor is terminated. In such modification, the crank chamber 25 is maintained at a state substantially the same as the suction chamber 38. This improves the durability of the swash plate 30, the lip seal 19, etc.

(2) The third path 51 may be defined in the cylinder block 11 to connect the crank chamber 25 to the suction chamber 38. In this case, a valve member is provided in the shutter 44 to serve as a restriction for the path 51. This modification enables the same advantages of the above embodiment to be obtained.

(3) The opening and closing of the first path 47 using the shutting surface 49 may be substituted by a valve that is synchronized with the opening and closing of the valve 64.

(4) An electromagnetic valve which restricts the cross-sectional area of the third path 51 and is synchronized with the opening and closing of the valve 64 may be employed.

What is claimed is:

1. A swash plate type compressor capable of compressing refrigerant gas introduced from an external refrigerant circuit and discharging the compressed refrigerant gas, comprising:

a housing having a suction chamber, a discharge chamber and a crank chamber defined in the housing, said crank chamber having a cylinder bore;

a swash plate tiltably supported on a drive shaft in the crank chamber, said swash plate being tiltable between a maximum inclining angle and a minimum inclining angle based on a differential pressure between the crank chamber and the suction chamber;

a single-headed piston coupled to the swash plate to reciprocate in the cylinder bore with a stroke based on the inclining angle of the swash plate, wherein said swash plate compresses the refrigerant gas introduced to the cylinder bore from the external refrigerant circuit via the suction chamber;

means for adjusting the pressure in the crank chamber to selectively increase and decrease the inclination angle of the swash plate;

said adjusting means including a first passage for introducing the refrigerant gas with low temperature from the external refrigerant circuit to substantially equalize the pressures in the crank chamber and the suction chamber, said first passage including:

a suction port communicating with the external refrigerant circuit and the suction chamber;

an accommodating chamber selectively connected and disconnected to the suction port by a movable means for selectively opening and closing the first passage in association with the maximum inclining angle and minimum inclining angle of the swash plate, wherein said first passage directly connects said suction port to the crank chamber through the accommodating chamber.

2. The compressor as set forth in claim 1, wherein said first passage further includes a guide passage for connecting the accommodating chamber and the crank chamber.

3. The compressor as set forth in claim 2, wherein said movable means includes:

a spool mounted on the end of the drive shaft in the accommodating chamber, said spool having an end surface opposite to the suction port;

a spring for biassing the spool toward the swash plate to connect the accommodating chamber with the suction port; and a bulge to bias the spool away from the swash plate against force of the spring so as to close the suction port with the end surface.

4. The compressor as set forth in claim 3, wherein said adjusting means includes a second passage for connecting the discharge chamber with the crank chamber to supply the refrigerant gas from the discharge chamber into the crank chamber so as to increase the pressure in the crank chamber.

5. The compressor as set forth in claim 4, wherein said second passage has an electromagnetic valve for selectively opening and closing the second passage.

6. The compressor as set forth in claim 5, wherein said adjusting means includes a third passage which allows the flow of the refrigerant gas from the crank chamber to the suction chamber.

7. The compressor as set forth in claim 6, said third passage includes a restriction which confines the flow of the refrigerant gas when the end surface of the spool closes the suction port.

8. The compressor as set forth in claim 7, wherein said third passage includes:

a longitudinal passage extending in the drive shaft along a substantially entire length thereof, said longitudinal passage opening into the spool;

a transverse passage extending in the drive shaft in a radial direction thereof;

a communicating chamber defined between the spool and the end of the drive shaft;

said spool having a through-hole;

an intervening passage disposed in association with the through-hole outside the spool, said intervening passage being arranged to connect with the communicating chamber via the through-hole so that the intervening passage is shifted relative to the through-hole based on a movement of the spool to serve as said restriction in cooperation with the through-hole; and a connecting passage for connecting the intervening passage with the suction chamber.

9. The compressor as set forth in claim 1, wherein said adjusting means includes:

a second passage for connecting the discharge chamber with the crank chamber to supply the refrigerant gas from the discharge chamber into the crank chamber so as to increase the pressure in the crank chamber; and an electromagnetic valve for selectively opening and closing the second passage.

10. The compressor as set forth in claim 9 further including an air conditioning switch which outputs a signal, said electromagnetic valve selectively opening and closing the second passage based on the signal.

11. A swash plate type compressor capable of compressing refrigerant gas introduced from an external refrigerant circuit and discharging the compressed refrigerant gas, comprising:

a housing having a suction chamber, a discharge chamber and a crank chamber defined in the housing, said crank chamber having a cylinder bore;

a swash plate tiltably supported on a drive shaft in the crank chamber, said swash plate being tiltable between a maximum inclining angle and a minimum inclining angle based on a differential pressure between the crank chamber and the suction chamber;

a single-headed piston coupled to the swash plate to reciprocate in the cylinder bore with a stroke based on the inclining angle of the swash plate, wherein said swash plate compresses the refrigerant gas introduced to the cylinder bore from the external refrigerant circuit via the suction chamber;

a first passage for introducing the refrigerant gas with low temperature from the external refrigerant circuit to substantially equalize the pressures in the crank chamber and the suction chamber, said first passage including:

a suction port communicating with the external refrigerant circuit and the suction chamber;

an accommodating chamber selectively connected and disconnected to the suction port by a movable means for selectively opening and closing the first passage in association with the maximum inclining angle and minimum inclining angle of the swash plate, said accommodating chamber accommodating an end of the drive shaft, wherein said first passage directly connects said suction port to the crank chamber through the accommodating chamber;

a second passage for connecting the discharge chamber with the crank chamber to supply the refrigerant gas from the discharge chamber into the crank chamber so as to increase the pressure in the crank chamber; and a third passage which allows the flow of the refrigerant gas from the crank chamber to the suction chamber.

12. The compressor as set forth in claim 11, wherein said first passage further includes a guide passage for connecting the accommodating chamber and the crank chamber.

13. The compressor as set forth in claim 12, wherein said movable means includes:

a spool mounted on the end of the drive shaft in the accommodating chamber, said spool having an end surface opposite to the suction port;

a spring for biassing the spool toward the swash plate to connect the accommodating chamber with the suction port; and a bulge to bias the spool away from the swash plate against force of the spring so as to close the suction port with the end surface.

14. The compressor as set forth in claim 13, wherein said second passage has an electromagnetic valve for selectively opening and closing the second passage.

15. The compressor as set forth in claim 14, said third passage includes a restriction which confines the flow of the refrigerant gas when the end surface of the spool closes the suction port.

16. The compressor as set forth in claim 15, wherein said third passage includes:

a longitudinal passage extending in the drive shaft along a substantially entire length thereof, said longitudinal passage opening into the spool;

a transverse passage extending in the drive shaft in a radial direction thereof;

a communicating chamber defined between the spool and the end of the drive shaft;

said spool having a through-hole;

an intervening passage disposed in association with the through-hole outside the spool, said intervening passage being arranged to connect with the communicating chamber via the through-hole so that the intervening passage is shifted relative to the through-hole based on a movement of the spool to serve as said restriction in cooperation with the through-hole; and a connecting passage for connecting the intervening passage with the suction chamber.

17. The compressor as set forth in claim 16, wherein said refrigerant gas contains oil mist for lubricating the third passage.

18. The compressor as set forth in claim 11, wherein said swash plate is made of light weight material.

19. The compressor as set forth in claim 18, wherein the swash plate is made of aluminum.

20. A swash plate type compressor capable of compressing refrigerant gas introduced from an external refrigerant circuit and discharging the compressed refrigerant gas, comprising:

a housing having a suction chamber, a discharge chamber and a crank chamber defined in the housing, said crank chamber having a cylinder bore;

a swash plate tiltably supported on a drive shaft in the crank chamber, said swash plate being tiltable between a maximum inclining angle and a minimum inclining angle based on a differential pressure between the crank chamber and the suction chamber;

a single-headed piston coupled to the swash plate to reciprocate in the cylinder bore with a stroke based on the inclining angle of the swash plate, wherein said swash plate compresses the refrigerant gas introduced to the cylinder bore from the external refrigerant circuit via the suction chamber;

a suction port communicating with the external refrigerant circuit and the suction chamber;

an accommodating chamber selectively connected and disconnected with the suction port by the movable means, said accommodating chamber accommodating an end of the drive shaft;

a guide passage for connecting the accommodating chamber and the crank chamber;

a pressure supply passage for connecting the discharge chamber with the crank chamber to supply the refrigerant gas from the discharge chamber into the crank chamber so as to increase the pressure in the crank chamber;

an electromagnetic valve for selectively opening and closing the pressure supply passage;

a lubricating passage which allows flow of the refrigerant gas from the crank chamber to the suction chamber, said refrigerant gas containing oil mist for lubricating its flowing passage;

a spool mounted on the end of the drive shaft in the accommodating chamber, said spool having an end surface opposite to the suction port;

a spring for biassing the spool toward the swash plate to connect the accommodating chamber with the suction port; and a bulge to bias the spool away from the swash plate against force of the spring so as to close the suction port with the end surface.

21. The compressor as set forth in claim 20, said lubricating passage including a restriction which confines the flow of the refrigerant gas when the end surface of the spool closes the suction port.

22. The compressor as set forth in claim 21, wherein said third passage includes:

a longitudinal passage extending in the drive shaft along a substantially entire length thereof, said longitudinal passage opening into the spool;

a transverse passage extending in the drive shaft in a radial direction thereof;

a communicating chamber defined between the spool and the end of the drive shaft;

said spool having a through-hole;

an intervening passage disposed in association with the through-hole outside the spool, said intervening passage being arranged to connect with the communicating chamber via the through-hole so that the intervening passage is shifted relative to the through-hole based on a movement of the spool to serve as said restriction in cooperation with the through-hole; and a connecting passage for connecting the intervening passage with the suction chamber.

23. The compressor as set forth in claim 22, wherein said swash plate is made of light weight material.

24. The compressor as set forth in claim 23, wherein the swash plate is made of aluminum.

* * * * *

UNITED STATES PATENT AND TRADEMARK OFFICE

CERTIFICATE OF CORRECTION

PATENT NO. : 5,842,834

DATED : December 1, 1998

INVENTOR(S) : Masahiro Kawaguchi, et al .

It is certified that error appears in the above-identified patent and that said Letters Patent is hereby corrected as shown below:

Column 2, line 65, change "an" to --a--.

Signed and Sealed this

Twenty-fifth Day of May, 1999

*Attest:*

Q. TODD DICKINSON

*Attesting Officer*

*Acting Commissioner of Patents and Trademarks*